United States Patent [19]

Hartung

[11] 4,025,962

[45] May 31, 1977

[54] POOL GLOVE

[75] Inventor: Donald H. Hartung, Waukesha, Wis.

[73] Assignee: Cue Products, Inc., Waukesha, Wis.

[22] Filed: Mar. 1, 1976

[21] Appl. No.: 662,944

[52] U.S. Cl. ..... 2/161 A

[51] Int. Cl.[2] ..... A41D 19/00

[58] Field of Search ..... 2/159, 161 R, 161 A, 2/21, 16, 167, 169; 273/54 B

[56] References Cited

UNITED STATES PATENTS

| | | | |
|---|---|---|---|
| 2,391,851 | 12/1945 | Willard | 2/159 X |
| 2,949,610 | 8/1960 | Lutsky | 2/16 |
| 3,229,306 | 1/1966 | Bazar | 2/161 A |
| 3,341,861 | 9/1967 | Robbins | 2/167 X |
| 3,387,306 | 6/1968 | Korey | 2/159 |
| 3,883,898 | 5/1975 | Byrnes | 2/167 |

*Primary Examiner*—G. V. Larkin

*Attorney, Agent, or Firm*—Andrus, Sceales, Starke & Sawall

[57] ABSTRACT

The invention is directed to a glove to be worn by pool players having a plurality of stalls which sheath the first and second fingers and the thumb of the user's hand to receive a pool cue when a shot is to be made. The third and fourth fingers are uncovered to provide for resting these latter fingers on the surface of the pool table to firmly support the first and second fingers through which the cue is passed. The glove is of flexible elastic material and extends slightly over the palm and back of the hand and is secured to the hand around the wrist area by a strap or the like.

1 Claim, 4 Drawing Figures

POOL GLOVE

BACKGROUND OF THE INVENTION

In performing a shot in pool the cue extends over the thumb and between the first and second fingers and the third and fourth fingers rest solidly on the pool table cushion to support the hand. It has been found that the fatty areas which are present in the engagement of the first and second fingers prevent a good solid grip of the cue, as the cue is moved between the fingers, because with a tight grip the fatty portion of the fingers tends to rotate as the cue is actuated between the fingers. By sheathing the thumb and first and second fingers in a clothlike, flexible material the grip on the cue between the first and second fingers can be increased and yet the material permits the cue to readily slide over the thumb and between the fingers.

SUMMARY OF THE INVENTION

The invention is directed to a pool glove of a material which covers the thumb and first and second fingers of the hand and leaves the third and fourth fingers uncovered to rest upon the pool table cushion and thereby firmly support the hand of the player. The glove covers a portion of the palm and back of the hand and is held in place by strap means at the wrist area of wearer.

DESCRIPTION OF THE PREFERRED EMBODIMENT

Figure 1:
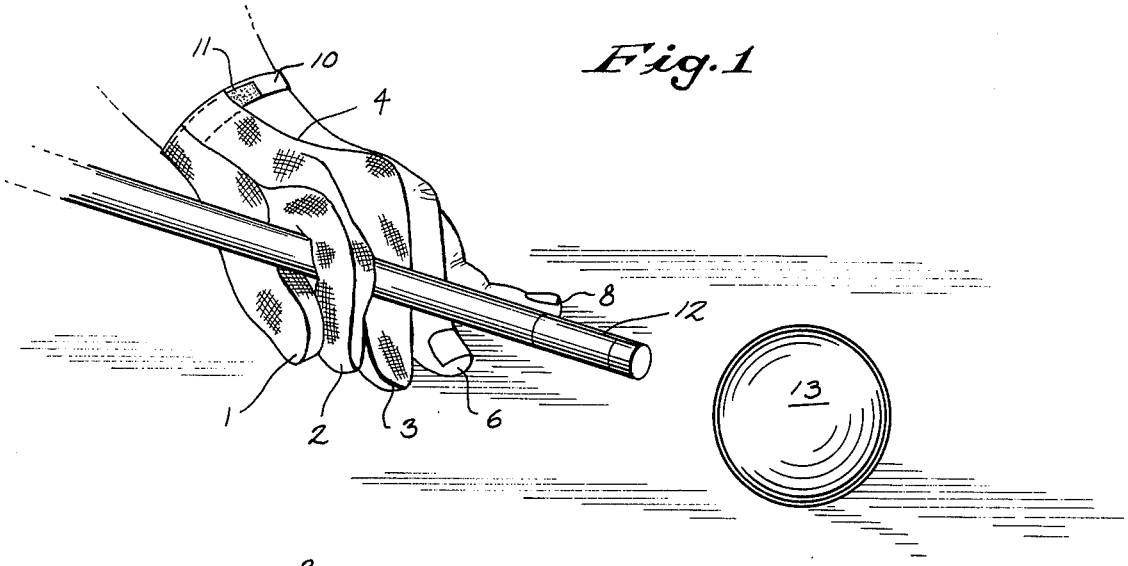
FIG. 1 is a perspective view with the glove of the invention on the hand of the wearer and illustrating a pool cue in position in the hand preparatory to striking a ball.

Referring to the drawings, there is shown a pool glove of preferably an elastic, flexible material such as of natural or synthetic fabric or the like.

The glove has a stall 1 to receive and sheath the thumb, a stall 2 to receive and sheath the first finger and a stall 3 to receive and sheath the second finger.

Figure 2:
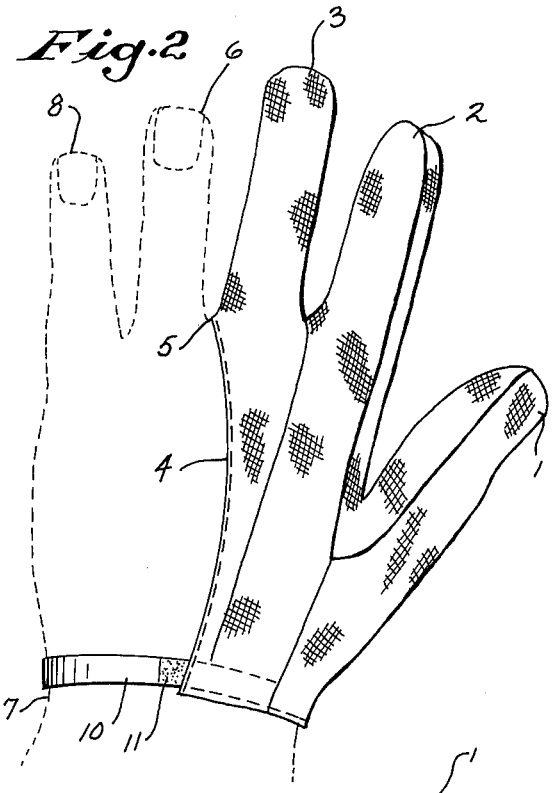
FIG. 2 is a top plan view showing the back of the glove as it extends over the thumb and first and second fingers and the back of the hand of a wearer with the third and fourth fingers shown in dotted lines.

Referring to FIG. 2, the side edge 4 of the back of the glove extends in a simicircular manner from the web 5 between the second finger and third finger 6 to a line adjacent the wrist 7 and midway of the hand to expose a considerable area on the back of the hand and the third finger 6 and fourth finger 8.

Figure 3:
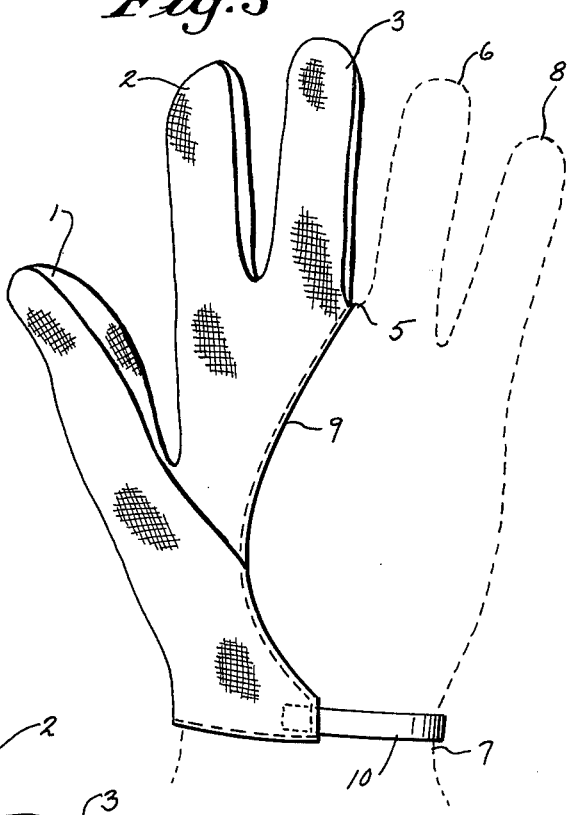
FIG. 3 is a top plan view illustrating the appearance of the front of the glove as it extends over the thumb and the first and second fingers and the palm of the hand of a wearer with the third and fourth fingers shown in dotted lines.
Figure 4:
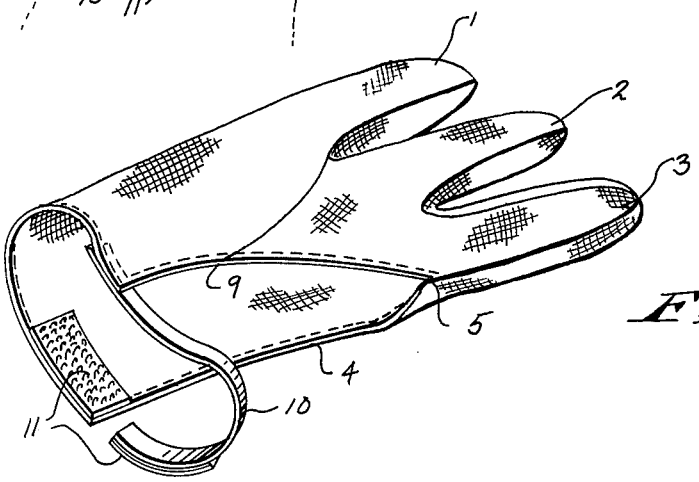
FIG. 4 is a perspective view of the glove as it appears removed from the hand of a user.

Referring to FIG. 3, the side edge 9 of the front or palm portion of the glove extends in a semicircular manner from the web 5 between the second finger and third finger 6 to the wrist 7 about midway of the hand to expose a considerable area of the palm of the hand and the third finger 6 and fourth finger 8. At the wrist 7, a strap 10, as illustrated in FIG. 4, is secured to the front or back of the glove and engages the holding material 11 to hold the glove in place on the wearer's hand.

Referring to FIG. 1, the glove of the invention is illustrated in use by the wearer.

The thumb, first finger and second finger are sheathed in their respective stalls 1, 2 and 3 and the third finger 6 and fourth finger 8 rest upon the cushion of the pool table, not shown, to support the hand, and the glove is strapped in place around the wrist of the wearer. The cue 12 extends over the stall 1 of the thumb and between the stalls 2 and 3 of the first and second fingers preparatory to engaging the ball 13.

In sheathing the thumb and first and second fingers with a flexible, elastic cloth or like material, the cue 12 can be securely gripped and yet slides readily over the thumb and between the first and second fingers. The rotation of the fatty portion of the fingers is prevented and in addition the texture of the glove tends to absorb the perspiration which may form on the thumb and fingers. By eliminating any sheathing of the third and fourth fingers, these fingers are unobstructed in bending movement to provide a solid foundation for support of the hand on the pool table.

The cut of the glove over the back and the front or palm of the hand can be modified in various ways from that illustrated and other means may be used than that described for holding the glove on a wearer's hand. The glove can be made of a plurality of pieces of material but the material should be flexible and elastic at least with respect to the thumb and first and second fingers so that a pool cue will readily slide through the material. Synthetic fibrous material, such as a fabric of nylon, Dacron (polyester), Orlon (acrylonitrile), for example, has been found to have the desired flexible and elastic qualities so that the glove will closely sheath the thumb and first and second fingers to provide a firm, tight grip of a cue but will provide the desired sliding movement of the cue.

Wearing of the pool glove of the invention provides for a more uniform stroke of the cue by the player and better control under the following conditions:

a. Normal perspiration especially for those people who will normally perspire more than others;
b. Nervous perspiration caused by high pressure shooting such as in tournament play;
c. Perspiration caused by humid and sticky atmosphere in the room in which the pool play is occurring.

The glove also eliminates the necessity for "powder up" (that is, aplying powder to the hands) and the resultant mess of the powder being lodged on the pool table and the player's clothes. Different types of wooden cues and those of metal and fiberglass present problems for the user and the use of the glove renders the texture of the pool cue immaterial. The glove allows the pressure to be increased in holding the cue to prevent wobbling of the cue and yet readily permits sliding movement in the gap between the first and second fingers. Because of the above factors the use of the glove greatly increases the confidence of the user.

Various modes of carrying out the invention are contemplated as being within the scope of the following claim particularly pointing out and distinctly claiming the subject matter which is regarded as the invention.

I claim:

1. A glove for use by pool players which covers only a portion of the palm of the hand and has stalls for receiving and sheathing the thumb and the first and second fingers and leaving the third and fourth finger exposed, said stalls being provided from clothlike, elastic, flexible material capable of absorbing perspiration produced by the wearer and which closely sheaths the thumb and said first and second fingers and provides for secure engagement of a pool cue disposed to extend between the first and second fingers and over the thumb but permitting ready slippage of the cue therethrough, additional material joining the stalls and extending over a portion of the back and the palm of the hand, means to secure the glove to the hand of the wearer, and with the uncovered portion of the hand and the third and fourth fingers providing a solid foundation for support of the hand when the third and fourth fingers and uncovered portion of the palm of the hand are placed in engagement with the cushion of a pool table preparatory to engaging a ball with a cue.

* * * * *